US006283789B1

(12) United States Patent
Tsai

(10) Patent No.: US 6,283,789 B1
(45) Date of Patent: Sep. 4, 2001

(54) DATA AND POWER TRANSMITTING CABLE SYSTEM

(76) Inventor: Shui Chuan Tsai, No. 3, Alley 80, Lane 108, Sec. 1, Kuang-Fu Road, Hsin-Chu (TW)

( * ) Notice: Subject to any disclaimer, the term of this patent is extended or adjusted under 35 U.S.C. 154(b) by 0 days.

(21) Appl. No.: 09/526,257

(22) Filed: Mar. 16, 2000

(51) Int. Cl.[7] ..... H01R 11/00
(52) U.S. Cl. ..... 439/502; 439/623
(58) Field of Search ..... 439/502, 623, 439/624

(56) References Cited

U.S. PATENT DOCUMENTS 4,981,438 * 1/1991 Bekheit ..... 439/76
5,855,064 * 1/1999 Chang ..... 29/861
5,971,800 * 10/1999 Azuma et al. ..... 439/502
6,007,372 * 12/1999 Wood ..... 439/502
6,152,778 * 11/2000 Dalton ..... 439/628

* cited by examiner

*Primary Examiner*—Brian Sircus
*Assistant Examiner*—Michael C. Zarroli
(74) *Attorney, Agent, or Firm*—Pro-Techtor International Services

(57) ABSTRACT

A data and power transmitting cable system that includes a first cable conforming to the USB or IEEE1394 standard. The first cable has a power supply wire and several data transmission wires and is plugged into a first port. The first cable provides for transmission of power and data. The system also includes at least one second cable, following the same standard. The second cable includes only power supply wires, with no data transmission wires. The second cable is plugged into a second port, allowing for transmission of additional power.

17 Claims, 8 Drawing Sheets

DATA AND POWER TRANSMITTING CABLE SYSTEM

BACKGROUND OF THE INVENTION

1. Field of the Invention

The present invention relates to a data and power transmitting cable system, particularly to a data and power transmitting cable system which improves on standard Universal Serial Bus and IEEE1394 cables by allowing for additional transmitted power.

2. Description of Related Art

Cables for connecting a computer with peripheral devices, like a keyboard, a mouse, a scanner or an external data storage device, have been increasingly standardized. For transmission speeds or data rates below 12 Mbits per second, Universal Serial Bus (USB) cables have increasingly been used. For higher data rates, of 100 Mbits per second and above, IEEE1394 cables have more and more come into use.

As shown in FIG. 22–24, a USB cable has an A connector 10, a first cable 15 and a B connector 20. The A connector has four metal pins, designated 1, 2, 3 and 4, used as Vbus, −Data, +Data and Ground pins, respectively. Accordingly, the B connector has four metal pins, designated 1*a*, 2*a*, 3*a*and 4*a*, used as Vbus, −Data, +Data and Ground pins, respectively. The first cable 15 has four metal wires, a first, a second, a third and a fourth wire. The first wire connects pins 1 and 1*a*, the second wire connects pins 2 and 2*a*, the third wire connects pins 3 and 3*a*, and the fourth wire connects pins 4 and 4*a*. The first and fourth wires form a power supply line, and the second and third wires are used for data transmission.

IEEE1394 cables (not shown) look different from USB cables. IEEE1394 cables have another two wires for data and thus have a total of six wires, two wires forming a power circuit and four wires being used for data transmission.

Electric voltages and currents in both USB cables and IEEE1394 cables are clearly defined. USB cables carry a voltage of +5V and a maximum current of 0.5 A. IEEE1394 cables carry a voltage of +8V to +40V and a maximum current of 1.5 A.

Devices connecting via a cable either have an extra power supply of their own or are supplied with power by the cable. Extra power supplies are mainly used for devices with relatively high power consumption, like scanners or storage devices. Devices with low power consumption, like keyboards or mouses, rely on power supplied by the cable.

Devices consuming more power than is admitted through the cable need installation of an extra power supply. As shown in FIGS. 25–27, a device 25 has a USB interface port 23 with four pins 1*b*, 2*b*, 3*b*, 4*b* which are respectively connected to the pins 1*a*, 2*a*, 3*a*, 4*a* of the B connector 20 of the USB cable. Furthermore, the device 25 has a power input jack 24 with two pins 5, 6. A power adapter 17 is plugged into the power input jack 24, connecting to the pins 5, 6 and supplying the device 25 with power. The power adapter 17 in turn is connected with a wall outlet, receiving power therefrom. If the device 25 needs just a little more power than is admitted through the USB cable, it is desirable to have another way to supply the device 25 than the extra power supply shown in FIGS. 25–27.

SUMMARY OF THE INVENTION

The present invention provides power for a device connected via a USB or IEEE1394 cable that consumes a little more power than is admitted through the USB or IEEE1394 cable.

An object of the present invention is to provide a data and power transmitting cable system which connects a main device and a peripheral device, adding a cable to be used only for power transmission for supplying the peripheral device with additional power while observing the USB and IEEE1394 standards.

Another object of the present invention is to provide a data and power transmitting cable system which saves costs and space for an extra power supply and which is easily mounted.

The main device used in conjunction with the present invention has a USB or IEEE1394 port or is a USB hub. The peripheral device used in conjunction with the present invention has a USB or IEEE1394 port for data and power connections to the main device.

The present invention connects the main device and the peripheral device according to the USB or IEEE1394 standards, adding a cable for additional power, so that, while observing the USB or IEEE1394 standards, the peripheral device is supplied with additional power. This is suitable if the peripheral device consumes a little more power than is admitted through the USB or IEEE1394 cable. This avoids the costs of an extra power supply for the peripheral device, and no extra space is needed, resulting in a simpler arrangement.

Since modern computers are provided with at least two USB ports, installing the present invention poses no problem. If there are not enough USB ports provided, a USB hub or a monitor with USB hub are preferably acquired and used.

The present invention can be more fully understood by reference to the following description and accompanying drawings.

DETAILED DESCRIPTION OF THE PREFERRED EMBODIMENTS

Figure 1:
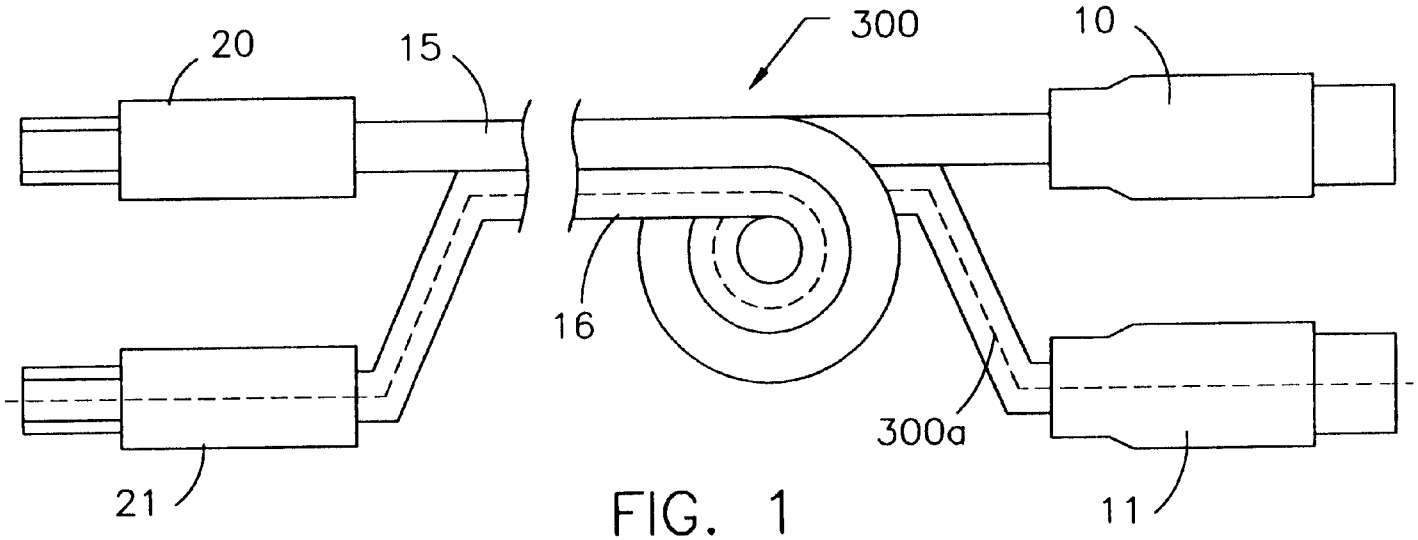
FIG. 1 is a schematic illustration of the data and power transmitting cable system of the present invention in the first embodiment.
Figure 2:
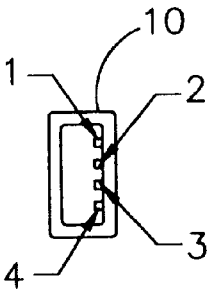
FIG. 2 is a face view of an A connector of the present invention in the first embodiment.
Figure 3:
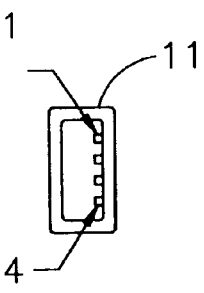
FIG. 3 is a face view of another A connector of the present invention in the first embodiment.
Figure 4:
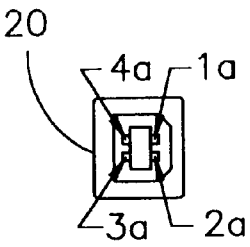
FIG. 4 is a face view of a B connector of the present invention in the first embodiment.
Figure 5:
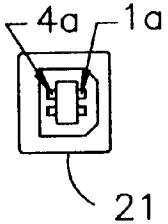
FIG. 5 is a face view of another B connector of the present invention in the first embodiment.
Figure 7:
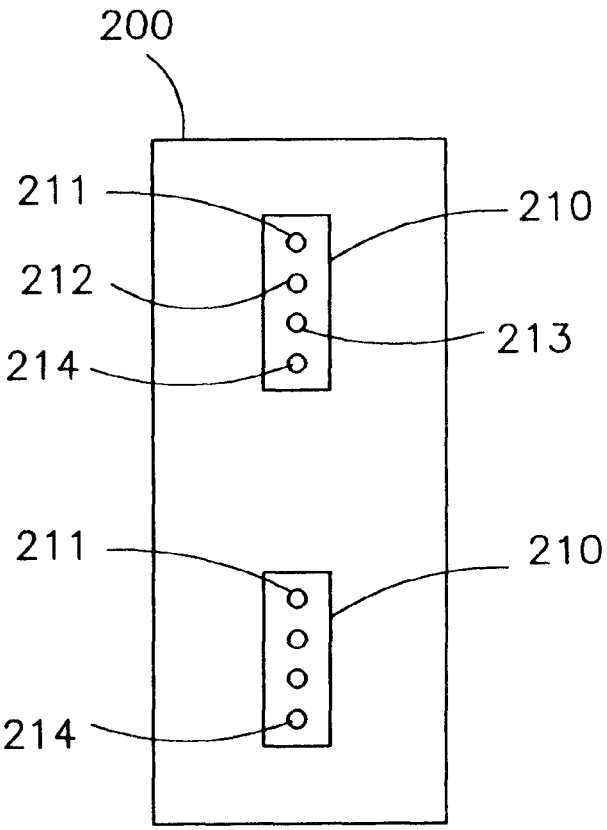
FIG. 7 is a schematic illustration of the main device port system used in conjunction with the present invention in the first embodiment.
Figure 6:
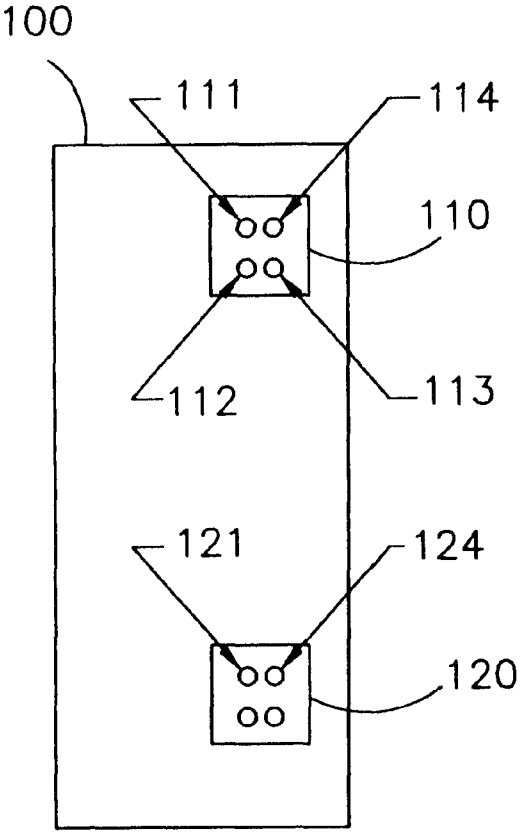
FIG. 6 is a schematic illustration of the peripheral device port system used in conjunction with the present invention in the first embodiment.
Figure 8:
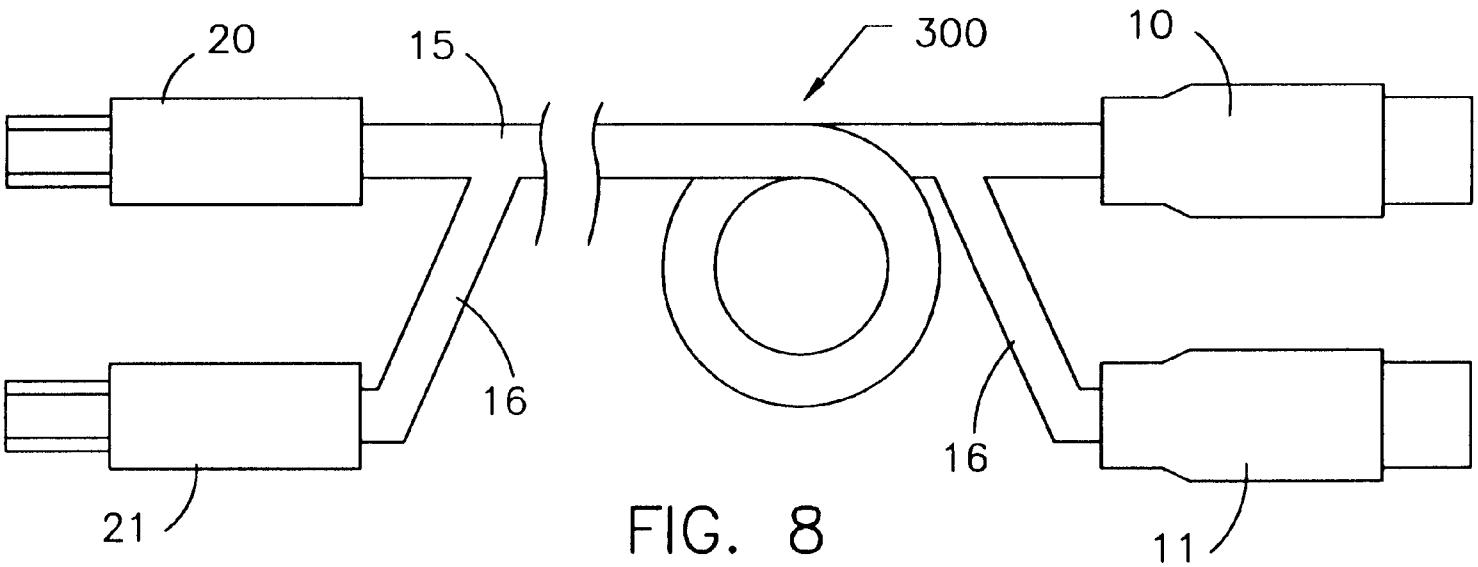
FIG. 8 is a schematic illustration of the data and power transmitting cable system of the present invention in the second embodiment.
Figure 12:
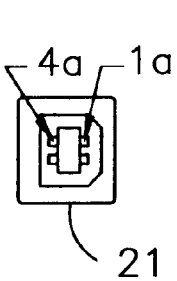
FIG. 12 is a face view of another B connector of the present invention in the second embodiment.
Figure 11:
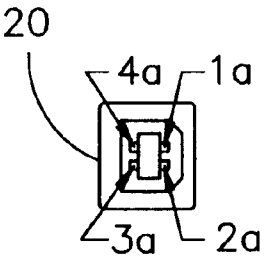
FIG. 11 is a face view of a B connector of the present invention in the second embodiment.
Figure 10:
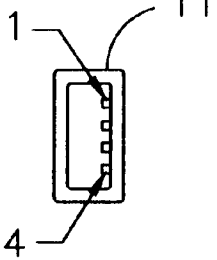
FIG. 10 is a face view of another A connector of the present invention in the second embodiment.
Figure 9:
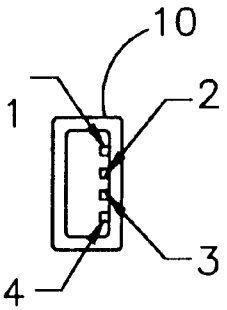
FIG. 9 is a face view of an A connector of the present invention in the second embodiment.

As shown in FIGS. 1–7, the data and power transmitting cable system of the present invention in a first embodiment is a cable system 300 (FIG. 1) used to connect a main device port system 200 (FIG. 7) and a peripheral device port system 100 (FIG. 6). The main device port system 200 is a computer USB port or IEEE1394 port. The peripheral device port system 100 is used in a peripheral device, like a storage device, a scanner or a printer. The cable system 300 provides a data connection between the main device port system 200 and the peripheral device port system 100 as well as a power connection from the main device port system 200 to the peripheral device port system 100.

The peripheral device port system 100 has a first port 110 and a second port 120. The main device port system 200 has two ports 210. The cable system 300 connects the first port 110 of the peripheral device 100 with the first of the two ports 210 of the main device 200 for transmission of power and data. Furthermore, the cable system 300 connects the second port 120 of the peripheral device 100 with the second of the two ports 210 of the main device 200, solely for transmission of additional power. Thus a supplementary power circuit is formed between the second port 120 and one of the ports 210 for delivering extra power to the peripheral device port system 100, without any need of an extra power supply.

The cable system 300 (shown in FIG. 1) of the first embodiment has, besides a first cable 15, a second cable 16, used for supplementary power transmission. An A connector 10 and a B connector 20 are attached to the ends of the first cable 15. The A connector 10 is inserted into one of the two ports 210 of the main device port system 200, having pins 1, 2, 3, 4 which connect to pins 211, 212, 213, 214 of the port 210, respectively. The B connector 20 is inserted into the first port 110 of the peripheral device port system 100, having pins 1*a*, 2*a*, 3*a*, 4*a* which connect to pins 111, 112, 113, 114 of the first port 110, respectively. The pins 1, 4 and 211, 214 conduct power, and the pins 2, 3 and 212, 213 conduct data, so that power and data are transmitted by the first cable 15 between the first port 110 and one of the two ports 210.

The second cable 16 has an A connector 11, inserted into one of the two ports 210 and a B connector 21, inserted into the second port 120. The first and second cables 15, 16 are individual cables or form a single cable. The B connector 21 has at least two pins, e.g. 1*a*, 4*a*, connecting to two pins 121, 124 on the second port 120. The A connector 11 has at least two pins, e.g. 1, 4, connecting to two pins 211, 214 on the port 210. Accordingly, at least two wires run along the second cable 16, connecting the pin 1*a*of the B connector 21 with the pin 1 of the A connector 11 and the pin 4a of the B connector 21 with the pin 4 of the A connector 11, respectively, forming a supplementary power cable system 300*a*. When using the data and power transmitting cable system of the present invention, a small extra power requirement beyond the USB or IEEE1394 standard is satisfied by the supplementary power cable system 300*a*.

Figure 22:
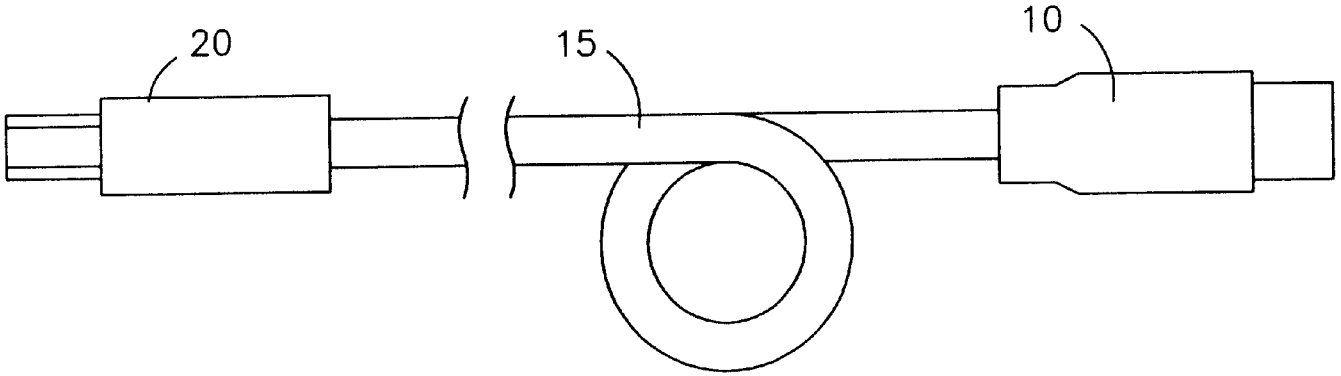
(PRIOR ART) FIG. 22
FIG. 22 (prior art) is a schematic illustration of a conventional USB cable.
Figure 24:
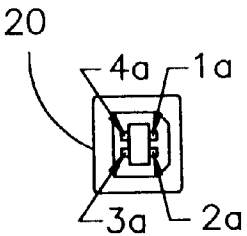
(PRIOR ART) FIG. 24
FIG. 24 (prior art) is a face view of a B connector of a conventional USB cable.
Figure 23:
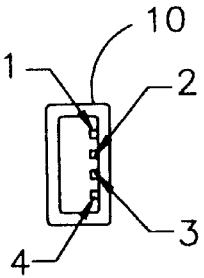
(PRIOR ART) FIG. 23
FIG. 23 (prior art) is a face view of an A connector of a conventional USB cable.
Figure 26:
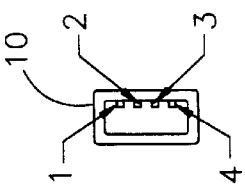
(PRIOR ART) FIG. 26
FIG. 26 (prior art) is a face view of an A connector of a conventional USB cable.
Figure 25:
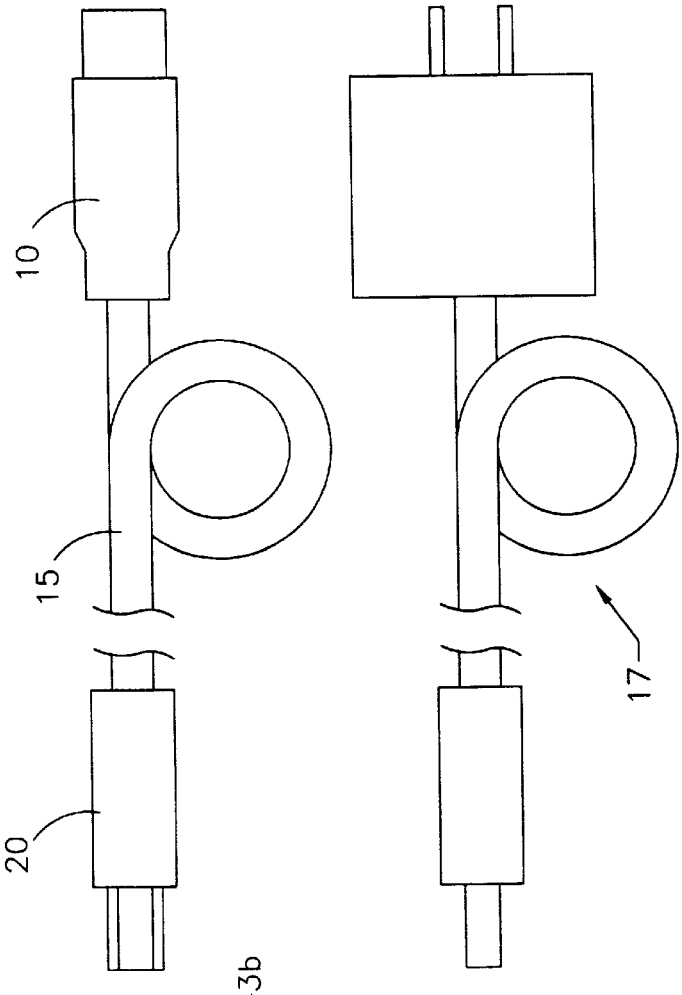
(PRIOR ART) FIG. 25
FIG. 25 (prior art) is a schematic illustration of a conventional USB cable in conjunction with a power adapter.
Figure 27:
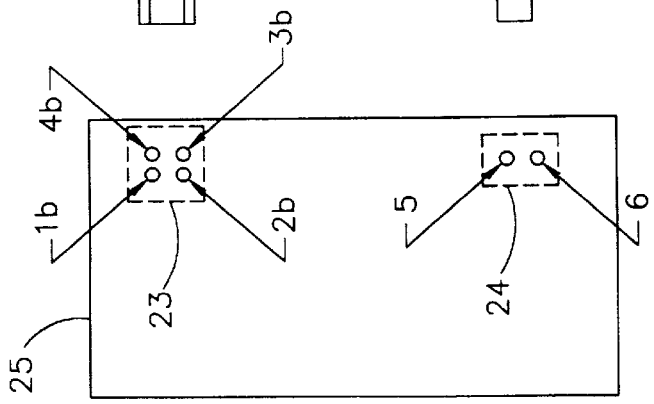
(PRIOR ART) FIG. 27
FIG. 27 (prior art) is a schematic illustration of a peripheral device port system used in conjunction with a conventional USB cable.

The cable system 300 of the present invention has further variations, fitting into the main device port system 200 and the peripheral device port system 100. Referring to FIGS. 8–12, in a second embodiment of the present invention the cable system, besides the structural parts of a conventional USB cable shown in FIG. 22–24, has another power cable system. The power cable system comprises a B connector 21, an A connector 11 and a second cable 16. The B connector 21 has at least two pins, e.g. 1*a*, 4*a*. The A connector 11 has at least two pins, e.g. 1, 4. At least two wires run along the second cable 16, connecting the pin 1*a* of the B connector 21 with the pin 1 of the A connector 11 and the pin 4*a* of the B connector 21 with the pin 4 of the A connector 11, respectively. Furthermore, the two wires are connected with wires of the first cable 15 that transmit power, for providing a power-transmitting circuit.

Furthermore, in the first and second embodiments of the present invention, the B connectors 20, 21, connecting to the peripheral device port system 100 have different features, like different colors, forms or tags to be clearly distinguished and to avoid mistakenly plugging the B connector 21 into the first port 110 and plugging the B connector 11 into the second port 120.

Figure 13:
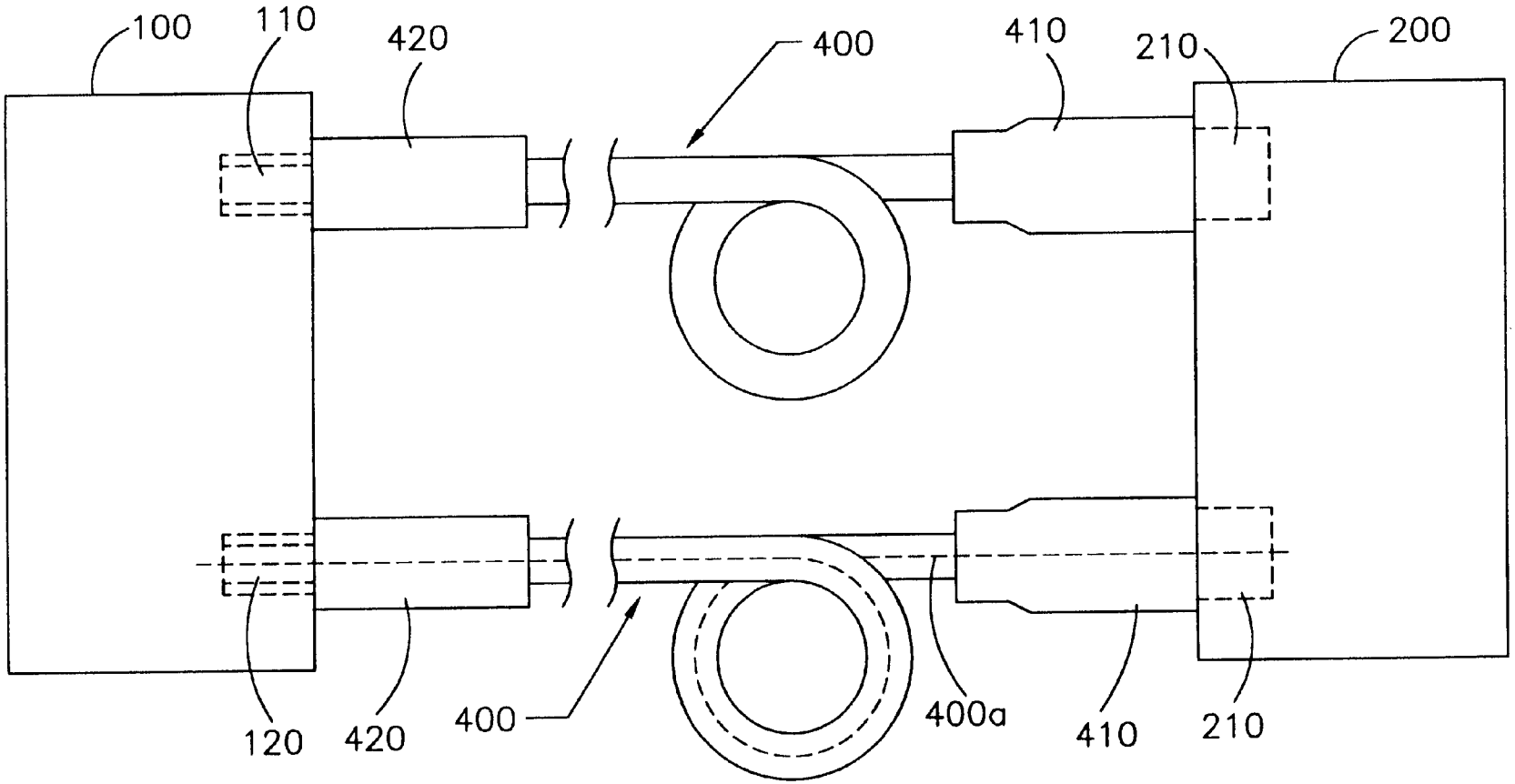
FIG. 13 is a schematic illustration of the data and power transmitting cable system of the present invention in the third embodiment.
Figure 14:
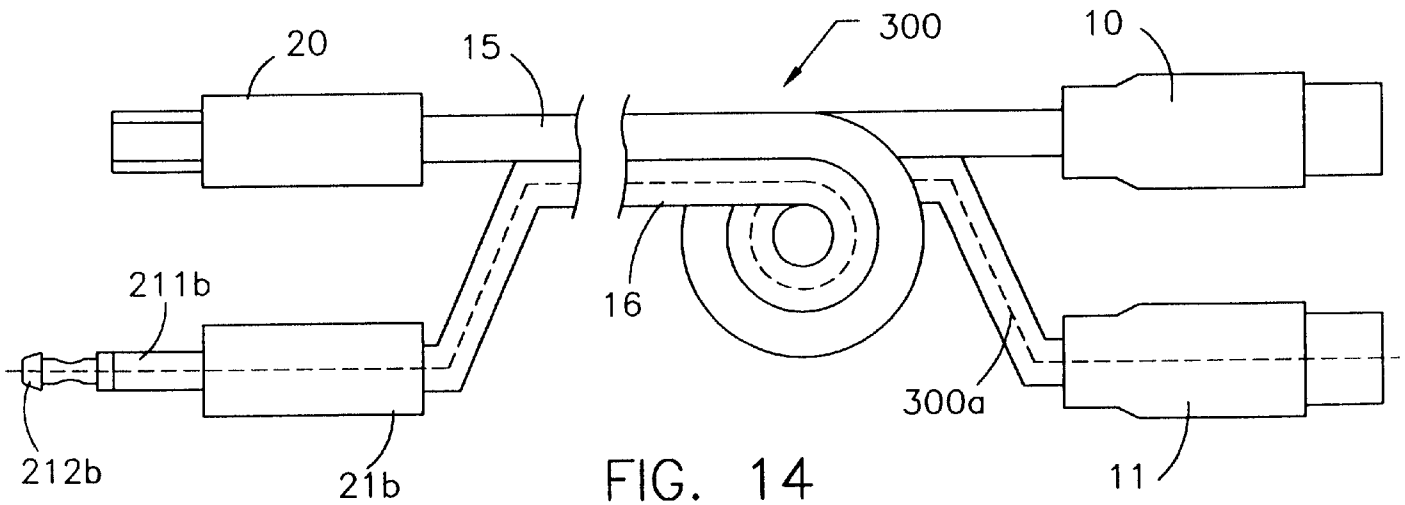
FIG. 14 is a schematic illustration of the data and power transmitting cable system of the present invention in the fourth embodiment.

Referring to FIG. 13, the present invention in a third embodiment works in conjunction with a peripheral device port system 100, having a first port 110 and a second port 120. The second port 120 has pins for power transmission, but no or disconnected pins for data transmission. Two standard USB or IEEE1394 cables 400 connect the first and second ports 110, 120 with two ports 210 of a main device port system 200. Each of the cables 400 has an A connector 410, plugged into one of the ports 210, and a B connector 420, plugged into the first or second port 110, 120.

Since the first port 110 has pins for power and data transmission, a power and data connection is established between the first port 110 and one of the two ports 210. On the other hand, only a power connection is established between the second port 120 and one of the two ports 210. Since the present invention in the third embodiment uses standard USB or IEEE1394 cables 400, no cable system 300 is needed, as in the first and second embodiments. This makes use more convenient.

Figure 18:
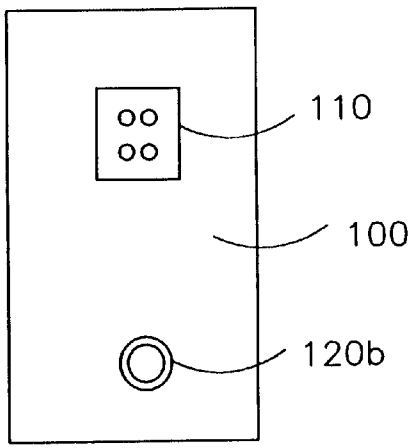
FIG. 18 is a schematic illustration of the peripheral device port system used in conjunction with the present invention in the fourth embodiment.
Figure 17:
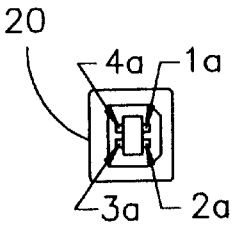
FIG. 17 is a face view of a B connector of the present invention in the fourth embodiment.
Figure 16:
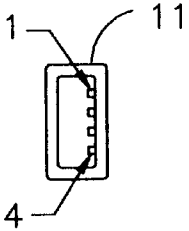
FIG. 16 is a face view of another A connector of the present invention in the fourth embodiment.
Figure 15:
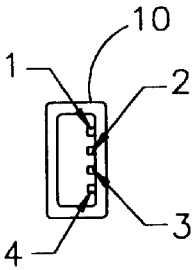
FIG. 15 is a face view of an A connector of the present invention in the fourth embodiment.

Referring to FIGS. 14–18, the present invention in a fourth embodiment has a cable system 300. The cable system 300 comprises two A connectors 10, 11, a B connector 20, and a coaxial connector 21b substituted for the B connector 21 of previous embodiments. The A connector has two pins 1, 4. The coaxial connector 21*b* has a common shape with two pins 211*b*, 212*b* which are connected with the pins 1, 4 of the A connector 11, respectively. Thus a supplementary power cable system is established. Furthermore, as shown in FIG. 18, the peripheral device port system 100 has a coaxial jack 120*b* into which the coaxial connector 21*b* is plugged. Since the coaxial connector 21*b* and the coaxial jack 120*b* are inexpensive parts, costs of the present invention in the fourth embodiment are kept low.

Figure 19:
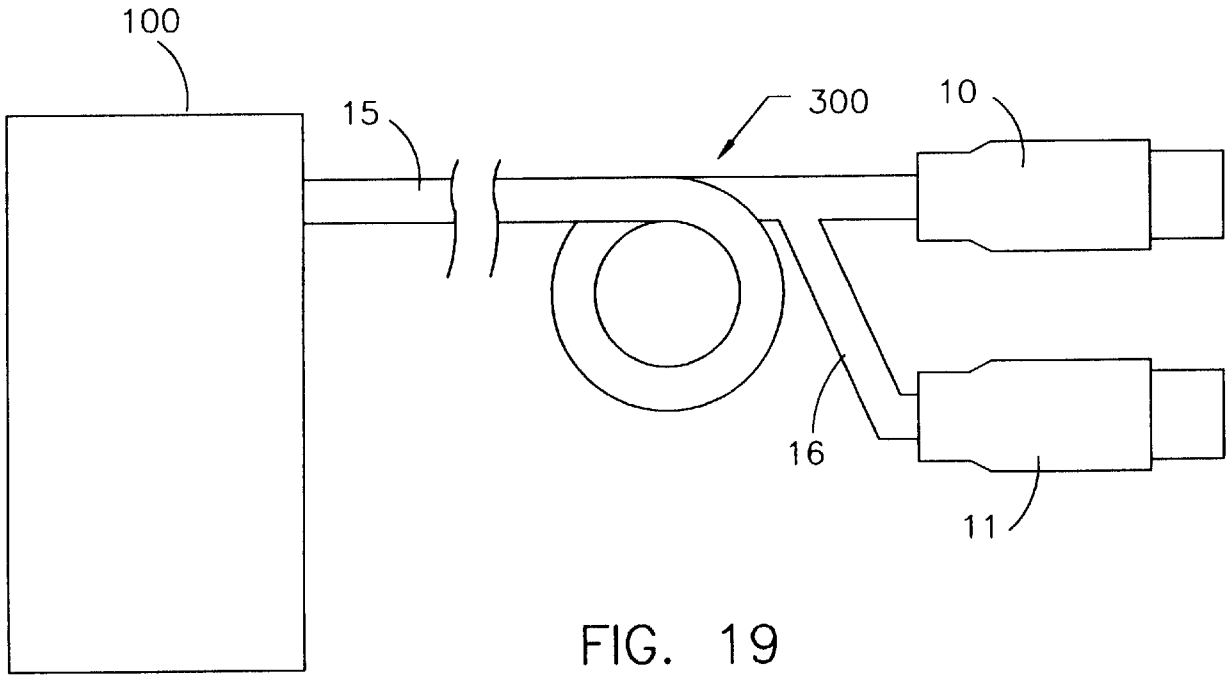
FIG. 19 is a schematic illustration of the data and power transmitting cable system of the present invention in the fifth embodiment.
Figure 21:
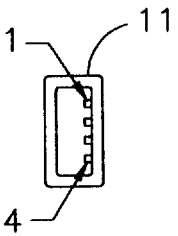
FIG. 21 is a face view of another A connector of the present invention in the fifth embodiment.
Figure 20:
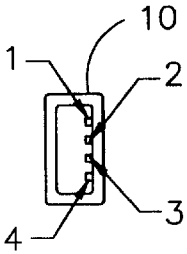
FIG. 20 is a face view of an A connector of the present invention in the fifth embodiment.

Referring to FIGS. 19–21, the present invention in a fifth embodiment works in conjunction with a peripheral device port system 100 and a main device port system 200 and has a cable system 300. The main device port system 200 has two ports 210. The cable system 300 comprises a first cable 15 and a second cable 16. The first cable 15 has two ends, which are directly connected with the peripheral device port system 100 and have an A connector 10 which is plugged into one of the two ports 210, respectively. Similarly, the second cable 16 has an end with an A connector 11 which is plugged into one of the two ports 210. The A connector 11 has two pins, e.g. 1 and 4, and the second cable 16 has two wires that end in the pins 1 and 4. Furthermore, the second cable has an end which is either directly connected with the peripheral device port system 100 or connected with the first cable 15, with the wires ending in power leading wires (not shown) in the first cable 15, thus being connected to the peripheral device port system 100.

The explanation given above takes USB cables as an example, but is in the same way applicable to IEE1394 cables, which are, apart from having two additional data wires while also having two power wires, similar to USB cables.

In the embodiments explained above one additional power supply line has been disclosed. More than one additional power supply line are also applicable in practice. Furthermore, cables and connectors for an additional power supply are preferably marked by colors and forms different from standard cables and connectors.

While the invention has been described with reference to preferred embodiments thereof, it is to be understood that modifications or variations may be easily made without departing from the spirit of this invention which is defined by the appended claims.

What is claimed is:

1. A data and power transmitting cable system, working in conjunction with a main device port system, which has at least two ports including a first port and a second port, each of said at least two ports having pins for transmitting power and data, and a peripheral device port system, said data and power transmitting cable system comprising:

a first cable, having a power supply line and at least one data line, a main end plugged into said first port of said main device port system and a peripheral end connected with said peripheral device port system, allowing for transmission of power and data; and at least one second cable, having a main end plugged into said second port of said main device port system and a peripheral end connected with said peripheral device port system, allowing for transmission of additional power from said main device port system to said peripheral device port system.

2. A data and power transmitting cable system according to claim 1, wherein said main end of said second cable has two pins and said peripheral end of said second cable has two pins, which are respectively connected with said two pins of said main end by two wires for transmitting power.

3. A data and power transmitting cable system according to claim 2, wherein said power line of said first cable has two wires which are ohmically connected with said two wires of said second cable.

4. A data and power transmitting cable system according to claim 1, wherein said first and second cables at said peripheral ends thereof have connectors that are distinguishable.

5. A data and power transmitting cable system according to claim 1, wherein said first and second cables have USB connectors.

6. A data and power transmitting cable system according to claim 1, wherein said first and second cables have IEEE1394 connectors.

7. A data and power transmitting cable system according to claim 1, wherein said first cable at said peripheral end thereof has a USB connector and said second cable at said peripheral end thereof has a common power connector.

8. A data and power transmitting cable system according to claim 1, wherein said first cable at said peripheral end thereof has a IEEE1394 connector and said second cable at said peripheral end thereof has a common power connector.

9. A data and power transmitting peripheral connecting system, working in conjunction with a main device port system, which has at least two ports including a first port and a second port, each of said at least two ports having pins for transmitting power and data, and a peripheral device, said peripheral connecting system comprising:

a first cable, having a power supply line and at least one data line, a main end with a connector plugged into said first port of said main device port system and a peripheral end connected with said peripheral device, allowing for transmission of power and data, and at least one second cable, having a main end with a connector plugged into said second port of said main device port system and a peripheral end, allowing for transmission of additional power from said main device port system to said peripheral device.

10. A data and power transmitting peripheral connecting system according to claim 9, wherein said peripheral end of said at least one second cable is connected with said power supply line of said first cable.

11. A data and power transmitting peripheral connecting system according to claim 9, wherein said peripheral end of said at least one second cable is connected with said peripheral device.

12. A data and power transmitting peripheral connecting system according to claim 9, wherein said peripheral end of said at least one second cable is connected with said peripheral device by a connector having solely power transmitting pins.

13. A data and power transmitting peripheral connecting system according to claim 9, wherein said first and second cables at said main ends thereof have USB connectors.

14. A data and power transmitting peripheral connecting system according to claim 9, wherein said first and second cables at said main ends thereof have IEEE1394 connectors.

15. A data and power transmitting peripheral connecting system, comprising:

a first port, having at least two pins for transmitting power and several pins for transmitting data and connected by a cable to a main device port system, allowing for transmission of power and data; and a second port, following a standard that is followed by said first port, except for having only pins for transmitting power, but no pins for transmission of data, allowing for transmission of additional power when connected with said main device port system.

16. A data and power transmitting peripheral connecting system according to claim 15, wherein said first and second ports have USB jacks.

17. A data and power transmitting peripheral connecting system according to claim 15, wherein said first and second ports have IEEE1394 jacks.

* * * * *